US006348758B1

(12) United States Patent
Kim et al.

(10) Patent No.: US 6,348,758 B1
(45) Date of Patent: Feb. 19, 2002

(54) FLAT TYPE COLOR CATHODE RAY TUBE

(75) Inventors: Wan Kim, Yongin; Soon-Cheol Shin, Suwon, both of (KR)

(73) Assignee: Samsung SDI Co., Ltd., Youngin (KR)

( * ) Notice: Subject to any disclaimer, the term of this patent is extended or adjusted under 35 U.S.C. 154(b) by 0 days.

(21) Appl. No.: 09/709,730

(22) Filed: Nov. 13, 2000

(30) Foreign Application Priority Data

Nov. 10, 1999 (KR) ..... 99-49714

(51) Int. Cl.[7] ..... H01J 29/80

(52) U.S. Cl. ..... 313/402; 313/403; 313/408; 313/461; 315/366; 315/1

(58) Field of Search ..... 313/402, 403, 313/407, 408, 461, 462; 315/366, 364, 1

(56) References Cited

U.S. PATENT DOCUMENTS

| | | | | | |
|---|---|---|---|---|---|
| 4,794,299 | A | | 12/1988 | Chiodi et al. | 313/402 |
| 4,915,658 | A | | 4/1990 | Lopata et al. | 445/30 |
| 4,942,332 | A | * | 7/1990 | Adler et al. | 313/402 |
| 4,973,879 | A | * | 11/1990 | Fujimura | 313/402 |
| 5,145,432 | A | | 9/1992 | Midland et al. | 445/3 |
| 5,169,351 | A | | 12/1992 | Choi | 445/60 |
| 5,363,011 | A | | 11/1994 | Fendley | 313/408 |
| 5,477,105 | A | | 12/1995 | Curtin et al. | 313/422 |
| 5,479,068 | A | * | 12/1995 | Muto | 313/461 |
| 5,576,596 | A | | 11/1996 | Curtin et al. | 313/422 |
| 5,725,787 | A | | 3/1998 | Curtin et al. | 216/25 |
| 5,745,168 | A | | 4/1998 | Ninomiya | 348/191 |
| 5,877,586 | A | * | 3/1999 | Aibara | 313/402 |
| 5,939,842 | A | | 8/1999 | Beeteson et al. | 315/366 |
| 6,140,754 | A | | 10/2000 | Ko | 313/407 |
| 6,175,185 | B1 | * | 1/2001 | Aibara | 313/402 |

* cited by examiner

*Primary Examiner*—Don Wong
*Assistant Examiner*—Tuvet T. Vo
(74) *Attorney, Agent, or Firm*—Robert E. Bushnell, Esq.

(57) ABSTRACT

A flat type color cathode ray tube (CRT) includes a bulb consisting of a flat type panel where a fluorescent film on which inner surface a fluorescent pattern and black matrix are coated is formed, and a funnel extended from the panel, and a frame assembly having a flat type shadow mask installed adjacent to the panel in the bulb and having a plurality of strips for forming a plurality of slits and a tie bar for connecting neighboring strips, wherein a vertical pitch of the black matrix formed on the fluorescent film is less than or equal to a vertical pitch of the tie bar of the flat type shadow mask.

45 Claims, 6 Drawing Sheets

FLAT TYPE COLOR CATHODE RAY TUBE

CLAIM OF PRIORITY

This application makes reference to, incorporates the same herein, and claims all benefits accruing under 35 U.S.C. §119 from my application FLAT TYPE COLOR CRT filed with the Korean Industrial Property Office on Nov. 10, 1999 and there duly assigned Ser. No. 49714/1999.

BACKGROUND OF THE INVENTION

1. Technical Field

The present invention relates to a flat type color cathode ray tube (CRT), and more particularly, to a flat type color CRT in which the pitch of a tie bar of a shadow mask is formed to be greater than or equal to the pitch of the black matrix formed on a fluorescent film of a panel.

2. Related Art

In a color cathode ray tube (CRT), an electron beam emitted from an electron gun passes through an electron beam passing hole of a shadow mask having a color selection function and lands on a fluorescent film formed on a surface of a screen of a panel. Thus, a fluorescent substance coated on the fluorescent film is excited and an image is formed. With a recent trend toward making a flat surface of a screen, a shadow mask installed in the cathode ray tube must be made flat compared to a convex surface of the non-flat one. As a doming phenomenon, the deformation of the shadow mask occurs due to heat during operation, it is not easy to manufacture a flat shadow mask.

I have found that it can be difficult to design and manufacture an improved high quality flat color cathode ray tube. Efforts have been made to improve a black matrix layer, a shadow mask, and a flat cathode ray tube display.

Exemplars of recent efforts in the art include U.S. Pat. No. 4,915,658 to Lopata et al., entitled REFERENCE AND SUPPORT SYSTEM FOR FLAT CRT TENSION MASK, issued on Apr. 10, 1990, U.S. Pat. No. 5,939,842 to Beeteson et al., entitled SELF STABILIZING ELECTRON SOURCE FOR FLAT PANEL CRT DISPLAYS, issued on Aug. 17, 1999, U.S. Pat. No. 5,745,168 to Ninomiya, entitled HOLE-SIZE MEASURING SYSTEM FOR CRT BLACK MATRIX LAYER, issued on Apr. 28, 1998, U.S. Pat. No. 5,725,787 to Curtin et al., entitled FABRICATION OF LIGHT-EMITTING DEVICE WITH RAISED BLACK MATRIX FOR USE IN OPTICAL DEVICES SUCH AS FLAT-PANEL CATHODE-RAY TUBES, issued on Mar. 10, 1998, U.S. Pat. No. 5,576,596 to Curtin et al., entitled OPTICAL DEVICES SUCH AS FLAT-PANEL CATHODE RAY TUBE, HAVING RAISED BLACK MATRIX, issued on Nov. 19, 1996, U.S. Pat. No. 5,477,105 to Curtin et al., entitled STRUCTURE OF LIGHT-EMITTING DEVICE WITH RAISED BLACK MATRIX FOR USE IN OPTICAL DEVICES SUCH AS FLAT-PANEL CATHODE-RAY TUBES, issued on Dec. 19, 1995, U.S. Pat. No. 5,363,011 to Fendley, entitled STRIP-TYPE SHADOW MASK EFFECTIVE TO ALLEVIATE DEGROUPING, issued on Nov. 8, 1994, U.S. Pat. No. 6,140,754 to Ko, entitled STRUCTURE OF SHADOW MASK FOR FLAT CATHODE RAY TUBE, issued on Oct. 31, 2000, U.S. Pat. No. 5,169,351 to Choi, entitled SHADOW MASK HEATING APPARATUS FOR COLOR CRT OF THE FLAT FACE-PLATE TYPE, issued on Dec. 8, 1992, U.S. Pat. No. 5,145,432 to Midland et al., entitled OPTICAL INTERPROGATION SYSTEM FOR USE IN CONSTRUCTING FLAT TENSION SHADOW MASK CRTS, issued on Sep. 8, 1992, and U.S. Pat. No. 4,794,299 to Chiodi et al., entitled FLAT TENSION MASK COLOR CRT FRONT ASSEMBLY WITH IMPROVED MASK FOR DEGROUPING ERROR COMPENSATION, issued on Dec. 27, 1988.

While these recent efforts provide advantages, I note that they fail to adequately provide an improved flat type color cathode ray tube.

SUMMARY OF THE INVENTION

To solve the above problems and others, it is an objective of the present invention to provide a flat type color cathode ray tube having improved visual recognition.

It is another objective of the present invention to provide a flat type color cathode ray tube in which the pitches of the tie bar of the shadow mask and the black matrix of the fluorescent film are changed.

Accordingly, to achieve the above objectives and others, there is provided a flat type color cathode ray tube including a bulb consisting of a flat type panel where a fluorescent film on which inner surface a fluorescent pattern and black matrix are coated is formed, and a funnel extended from the panel, and a frame assembly having a flat type shadow mask installed adjacent to the panel in the bulb and having a plurality of strips for forming a plurality of slits and a tie bar for connecting neighboring strips, in which a vertical pitch of the black matrix formed on the fluorescent film is less than or equal to a vertical pitch of the tie bar of the flat type shadow mask.

It is preferred in the present invention that the vertical pitch of the black matrix of the fluorescent film is formed between 0.3 mm through 1.9 mm. Also, it is preferred in the present invention that the vertical pitch of the black matrix of the fluorescent film is formed between 0.4 mm through 1.5 mm.

Also, it is preferred in the present invention that the vertical pitch of the tie bar of the flat type shadow mask is an integer multiple of the vertical pitch of the black matrix of the fluorescent film.

To achieve these and other objects in accordance with the principles of the present invention, as embodied and broadly described, the present invention provides an apparatus, comprising: a display unit conveying varying visual images to a user; a fluorescent film being formed on a surface of said display unit, said fluorescent film having fluorescent patterns; a black matrix being coated on said fluorescent film between said fluorescent patterns; a mask being mounted adjacent to said display unit, said mask forming at least one tie bar, a plurality of slits, and a plurality of adjacent strips, said strips being disposed between said slits, said at least one tie bar connecting said adjacent strips, a first pitch of said black matrix and a second pitch of said at least one tie bar forming a predetermined ratio; and a light source emitting light through at least one of said slits to said display unit to form the images at said display unit.

To achieve these and other objects in accordance with the principles of the present invention, as embodied and broadly described, the present invention provides a flat type color cathode ray tube display apparatus, comprising: a flat type color cathode ray tube; a flat type panel being located at a front region of said flat type color cathode ray tube; fluorescent patterns being formed on an inner surface of said panel; a black matrix being applied on said inner surface of said panel between said fluorescent patterns; a flat type shadow mask being mounted adjacent to said panel, said mask forming at least one tie bar, a plurality of slits, and a plurality of adjacent strips, said strips being disposed between said slits, said at least one tie bar connecting said adjacent strips, a first measurement of said black matrix and a second measurement of said at least one tie bar forming a predetermined ratio; and an electron source emitting an electron beam passing through at least one of said slits of said mask to said panel to form an image, said mask being disposed between said electron source and said panel.

To achieve these and other objects in accordance with the principles of the present invention, as embodied and broadly described, the present invention provides a method, comprising: forming a fluorescent film on a surface of a display unit, said fluorescent film having fluorescent patterns; applying a black matrix onto said fluorescent film between said fluorescent patterns; placing a mask at a location adjacent to said display unit, said mask forming at least one tie bar, a plurality of slits, and a plurality of adjacent strips, said strips being disposed between said slits, said at least one tie bar connecting said adjacent strips, a first pitch of said black matrix and a second pitch of said at least one tie bar forming a predetermined ratio; and emitting light through at least one of said slits to said display unit to form an image at said display unit.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
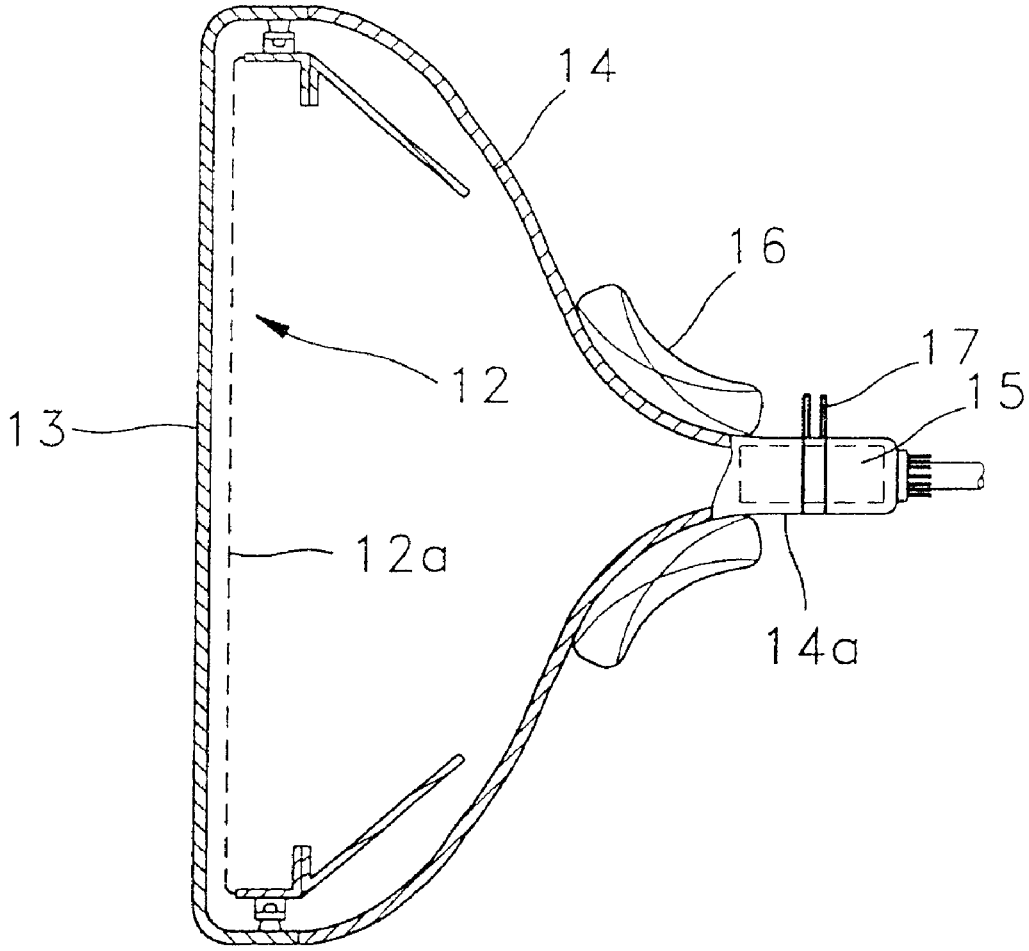
FIG. 1 is a view showing a flat type color cathode ray tube.

FIG. 1 is a side sectional view showing the structure of a flat type color cathode ray tube (CRT). Referring to the drawing, a color cathode ray tube assembly includes a bulb consisting of a panel 13 where a shadow mask frame assembly 12 is installed and a funnel 14 having a neck portion 14*a* into which an electron gun 15 is inserted, a deflection yoke 16 installed at the outer circumferential surface of the neck portion 14*a*, and a convergence purity magnet assembly 17.

In the color cathode ray tube having the above structure, the fluorescent film formed on an inner surface of the panel 13 is formed by sequentially coating fluorescent substances of red, green and blue on a predetermined portion of the panel 13. A black matrix is coated on the surface of the panel 13 between the respective fluorescent patterns. The fluorescent pattern can be formed in a dot type or strip type. The surface of the panel 13 is formed in a flat type and the shadow mask 12*a* provided to the shadow mask frame assembly 12 is assembled in a state of receiving tension.

Figures 2, 2A:
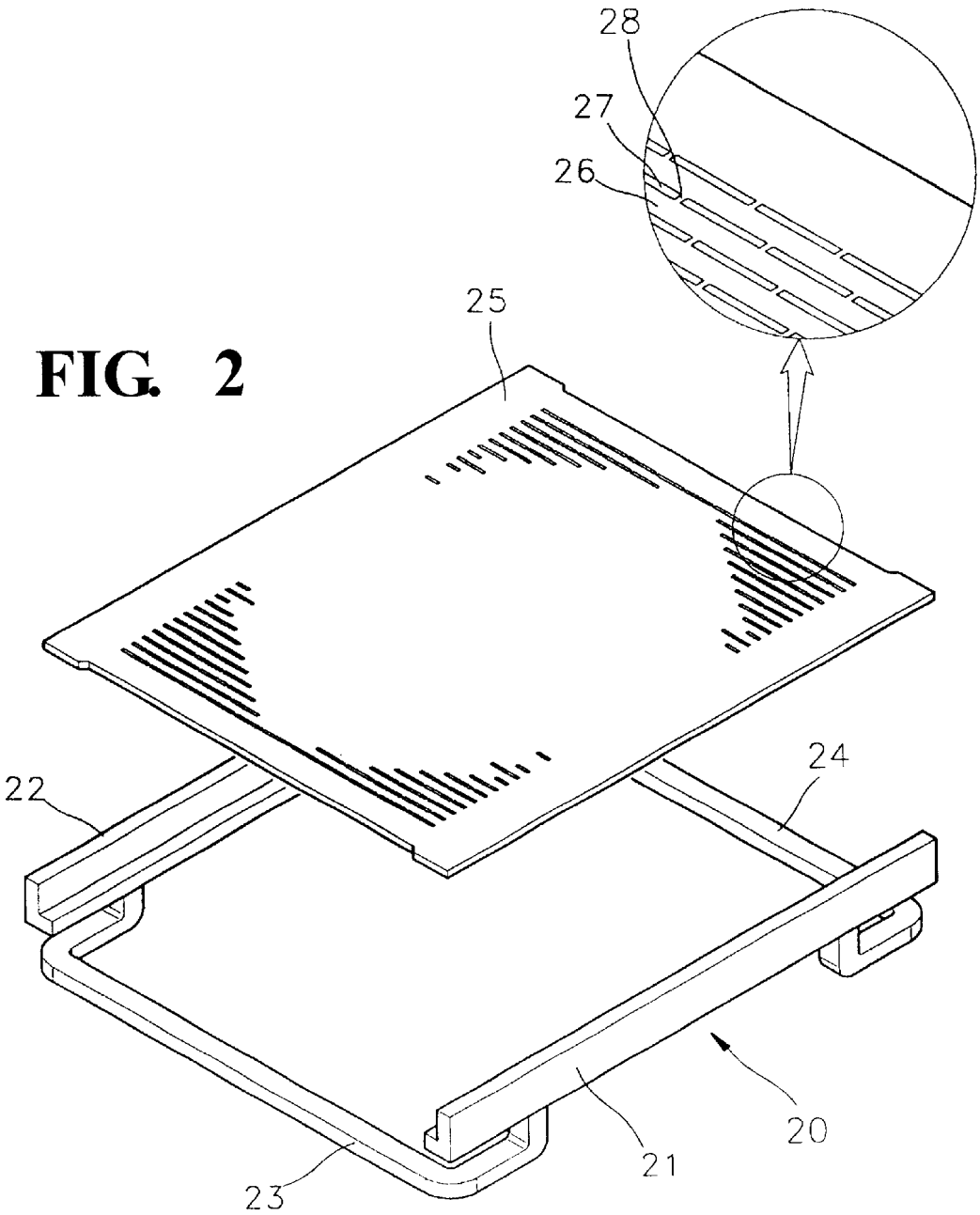
FIGS. 2 and 2A together form an exploded perspective view showing a shadow mask frame assembly for a flat type color cathode ray tube.

FIGS. 2 and 2A together form a perspective view showing an example of a shadow mask frame assembly applied to a flat type color cathode ray tube. Referring to the drawing, a shadow frame assembly includes first and second support members 21 and 22 installed parallel to each other, a frame 20 having first and second elastic members 23 and 24 of which both ends are fixed to both sides of the first and second support members 21 and 22 for maintaining the interval between the support members 21 and 22, and a flat type shadow mask 25, having a plurality of strips 26 forming a plurality of slits 27, of which corresponding edges, that is, long sides are welded to the support members 21 and 22 so that tension is applied by the support members 21 and 22. The strips 26 are connected by a tie bar 28 with respect to other adjacent strip.

Figure 3A:
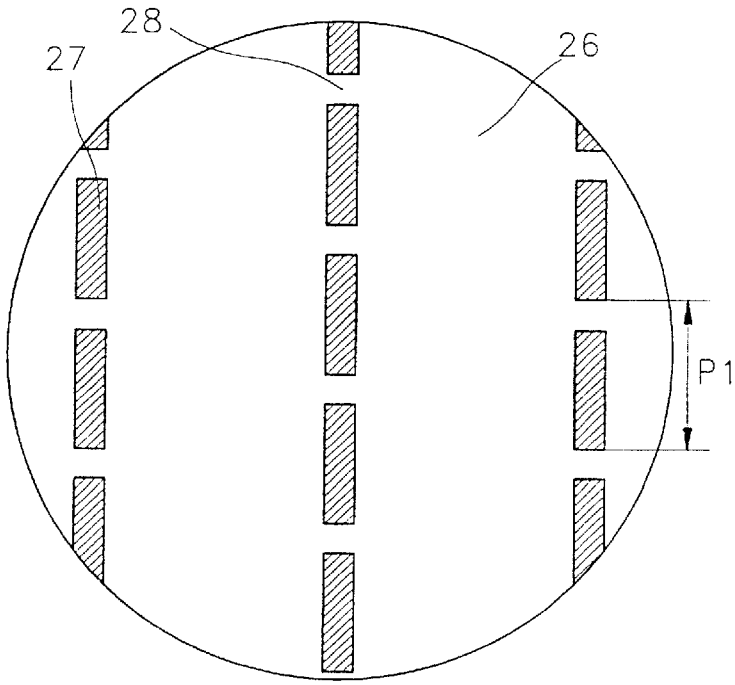
FIG. 3A is a magnified view showing a shadow mask for the flat type color cathode ray tube of FIGS. 2 and 2A.
Figure 3B:
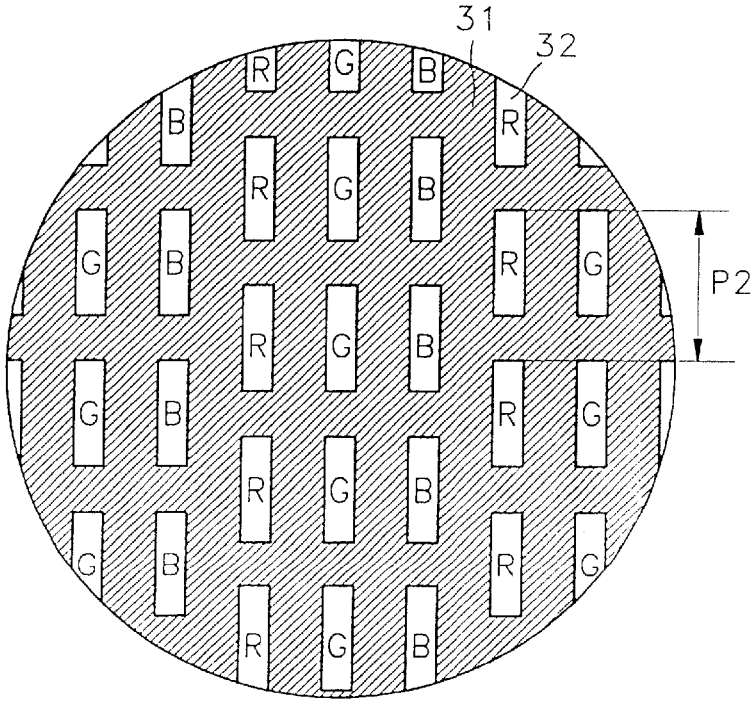
FIG. 3B is a magnified view showing a fluorescent film for the flat type color cathode ray tube of FIGS. 2 and 2A.

FIG. 3A is a magnified view showing a part of the flat type shadow mask frame shown in FIGS. 2 and 2A. FIG. 3B is a magnified view showing the fluorescent film formed on the inner surface of the panel 13 shown in FIG. 1. Referring to FIG. 3A, the tie bar 28 connected the neighboring strips 26 is separated at a pitch P1 in a vertical direction. Referring to FIG. 3B, the fluorescent pattern 32 of red, green and blue is formed in the black matrix 31 and a vertical pitch of the black matrix 31 is formed to be P2.

The vertical pitch P1 of the tie bar 28 can be formed to be less than the vertical pitch P2 of the black matrix 31. For example, the vertical pitch P1 of the tie bar 28 can be formed to be 10% less than the vertical pitch P2 of the black matrix 31. The vertical pitch P1 of the tie bar 28 can be set to be 0.5 to 1.5 millimeters (mm) while the vertical pitch P2 of the black matrix 31 is set to be 0.52 to 2 mm.

Here, if the vertical pitch P1 of the tie bar 28 is set to be over 2 mm beyond the above range, then the vertical pitch P2 of the black matrix 31 should be greater than the vertical pitch P1 of the tie bar 28. Here, it is a problem that the black matrix 31 can be recognized through the naked eye due to the tie bar 28 when an image is displayed. This is because the electron beam incident on the fluorescent film through the shadow mask is blocked by the tie bar 28 so that a sufficient fluorescent operation does not occur at the fluorescent pattern corresponding to an area where the electron beam is shielded. Thus, the black matrix 31 can be recognized through the naked eye.

The overall configuration of a flat type color cathode ray tube according to the present invention is similar but not identical to that of the cathode ray tube described with reference to FIGS. 1 through 2A. That is, as shown in FIG. 1, a fluorescent film is formed on an inner surface of the panel 13 and a bulb consists of a panel 13 where a shadow mask frame assembly 12 is installed and a funnel 14 in which an electron gun 15 is inserted in a neck portion 14*a*. A deflection yoke 16 installed at the outer circumferential surface of the neck portion 14*a*, and a convergence purity magnet assembly 17. As shown in FIGS. 2 and 2A, a shadow frame assembly includes first and second support members 21 and 22 installed parallel to each other, a frame 20 having first and second elastic members 23 and 24 of which both ends are fixed to both sides of the first and second support members 21 and 22 for maintaining the interval between the support members 21 and 22, and a flat type shadow mask 25, having a plurality of strips 26 forming a plurality of slits 27, of which corresponding edges, that is, long sides are welded to the support members 21 and 22 so that tension is applied by the support members 21 and 22.

Figure 4A:
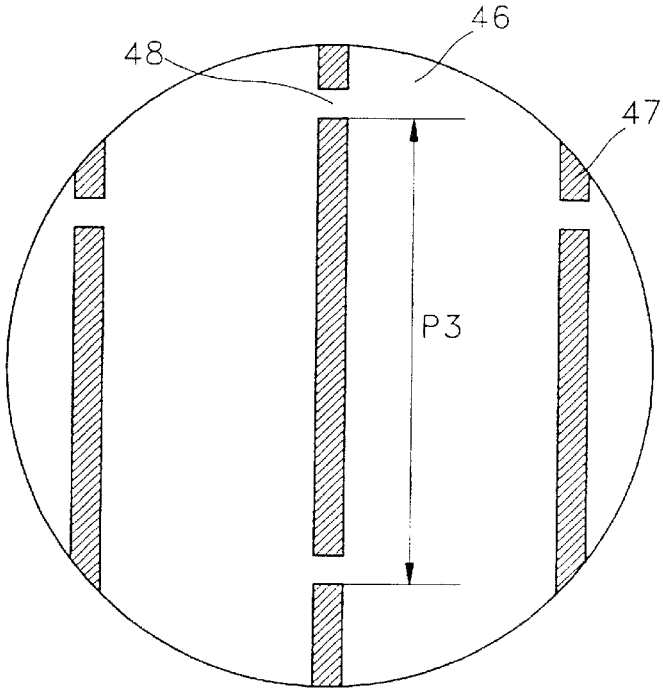
FIG. 4A is a magnified view showing a shadow mask for a flat type color cathode ray tube, in accordance with the principles of the present invention.
Figure 4B:
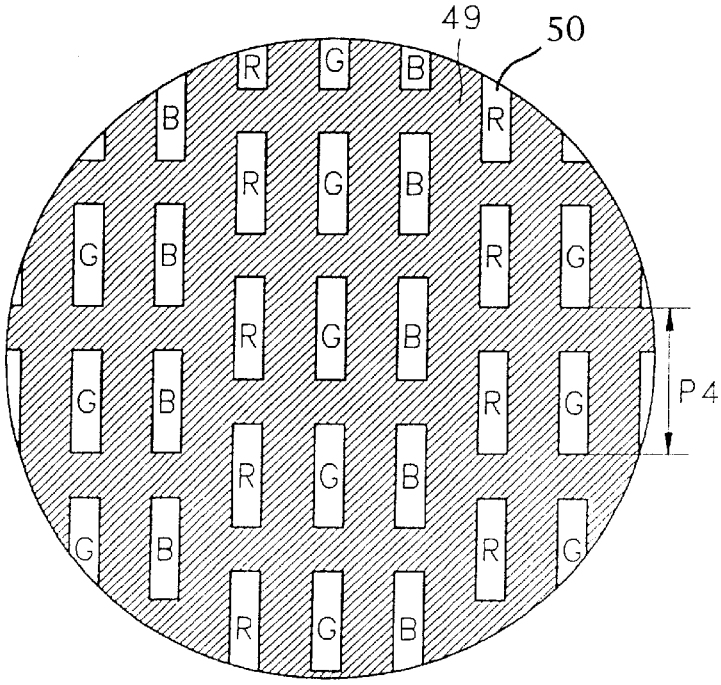
FIG. 4B is a magnified view showing a fluorescent film for a flat type color cathode ray tube, in accordance with the principles of the present invention.

FIGS. 4A and 4B show part of a flat type shadow mask and a fluorescent film according to the present invention. Referring to FIG. 4A, a plurality of slits 47 which are passing holes for electron beams are formed at the shadow mask. The slits 47 are formed between the neighboring strips 46. Also, the slits 47 is partitioned by a tie bar 48. The both end portions of the tie bar 48 connect the adjacent strips 46 which are vertically extended. The vertical pitch of the tie bar 48 is indicated by P3.

Referring to FIG. 4B, a fluorescent pattern 50 of red R, green G and blue B is formed on the fluorescent film and a black matrix 49 is formed therebetween. The vertical pitch of the black matrix 49 is indicated by P4.

According to the characteristic feature of the present invention, the vertical pitch P4 of the black matrix 49 of the fluorescent film is formed to be less than or equal to the vertical pitch P3 of the tie bar 48 of the shadow mask. By setting the vertical pitch P3 and P4 as above, the pitch P3 of the tie bar 48 can be extended compared to other technology. Accordingly, the length of each of the slits 47 is extended. Thus, a sufficient amount of an electron beam through the slits 47 can reach the entire length of the fluorescent pattern 50 which becomes shorter. Also, during display, the black matrix 49 is not visible through the naked eyes. In other words, the black matrix 49 is not visible to an unaided human eye during display.

With reference to FIGS. 4A and 4B, the size of pitch P3 corresponds to the size of one slit 47 and one tie bar 48. The size of pitch P4 corresponds to the size of a portion of the fluorescent pattern 50 and black matrix 49. In accordance with the principles of the present invention, the FIGS. 4A and 4B illustrate the fact that it is desirable to increase the size of pitch P3 in relation to the size of pitch P4. In accordance with the principles of the present invention, pitch P3 is larger than pitch P4. This ratio between P3 and P4 is desirable so that a viewer is less likely to see effect of a tie bar 48 blocking an electron beam.

With reference to FIGS. 3A and 3B, the size of pitch P1 corresponds to the size of one slit 27 and one tie bar 28. The size of pitch P2 corresponds to the size of a portion of the fluorescent pattern 32 and black matrix 31. The FIGS. 3A and 3B depict a device which does not follow the principles of the present invention. As shown in FIGS. 3A and 3B, the size of pitch P1 is smaller than the size of pitch P2. The problem with the device depicted in FIGS. 3A and 3B is that the black matrix 31 can be recognized because of the size of a slit 27 and the location of a tie bar 28. The tie bar 28 blocks the electron beam and causes the black matrix 31 to be visible to the unaided or naked eye of a viewer. The black matrix 31 becomes more visible to the unaided eye of a viewer when the electron beam impinging on the fluorescent pattern 32 is insufficient to satisfactorily excite the fluorescent pattern 32. When the fluorescent pattern 32 is insufficiently excited, the black matrix 31 becomes more apparent to a viewer. This is the problem that is solved by the present invention.

When the pitch P3 is larger than the pitch P4, as depicted in FIGS. 4A and 4B in accordance with the principles of the present invention, then the aforementioned problem is solved. The slit 47 and tie bar 48 (in accordance with the principles of the present invention) block less of the electron beam than do the slit 27 and tie bar 28, and thus the black matrix 49 is less apparent to a viewer than is the black matrix 31.

The fluorescent pattern 50 shown in FIG. 4B is sufficiently excited by the electron beam passing through slit 47 so that the black matrix 49 is not visible to the unaided eye of a viewer. When a fluorescent film is excited by an electron beam, an image is formed. The pitch P1 can be said to be a pitch of a tie bar, as depicted in FIG. 3A. The pitch P2 can be said to be a pitch of a black matrix, as depicted in FIG. 3B. The pitch P3 can be said to be a pitch of a tie bar, as depicted in FIG. 4A. The pitch P4 can be said to be a pitch of a black matrix, as depicted in FIG. 4B.

In the preferred embodiment, the vertical pitch P4 of the black matrix 49 is set in a range of 0.3–1.9 mm, preferably, between 0.4–1.5 mm. Also, the vertical pitch P3 of the tie bar 48 of a flat type shadow mask is preferably set to about 2 mm or more and to 3.79 mm at its maximum.

Figure 5:
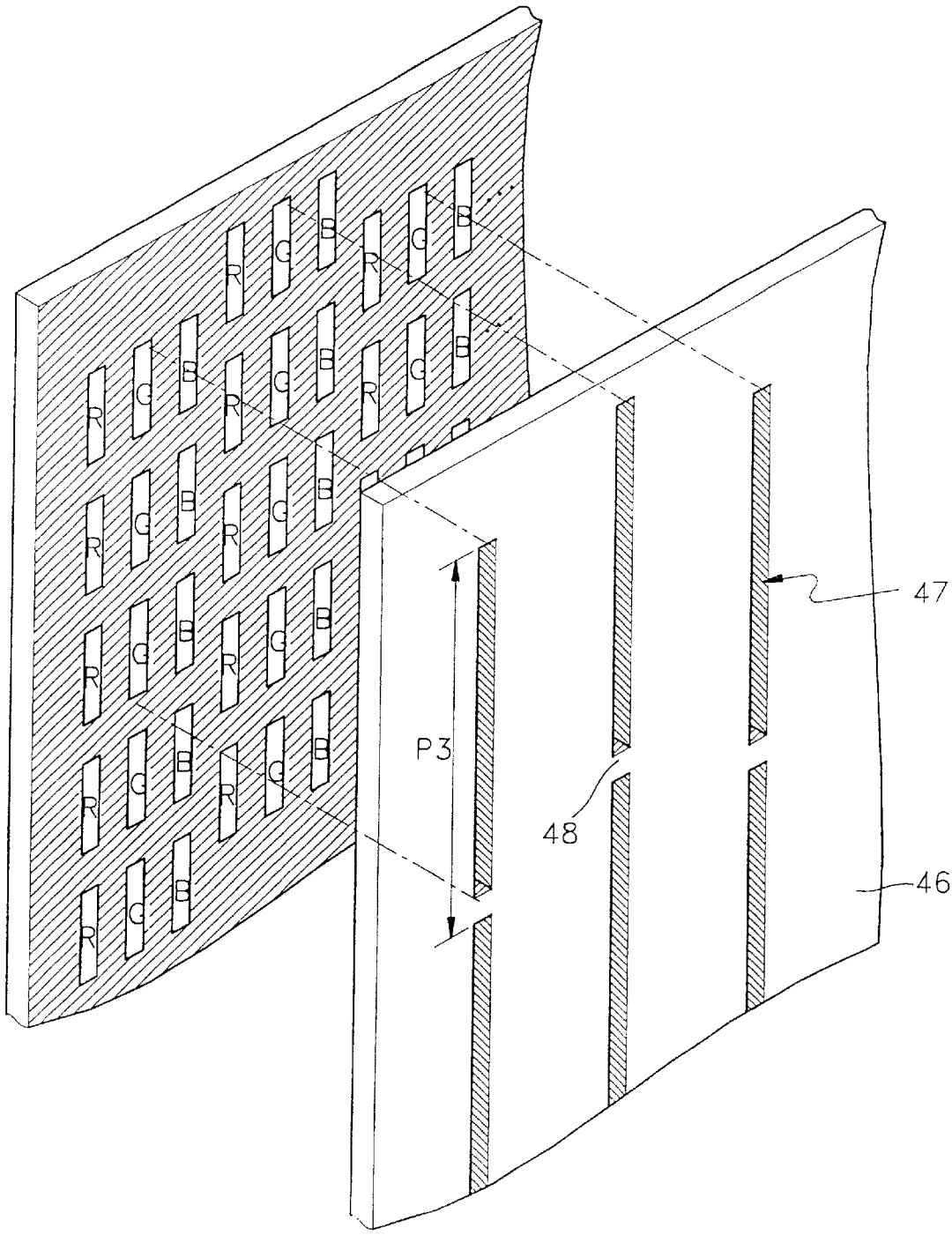
FIG. 5 is a perspective view showing the fluorescent film and the shadow mask, in accordance with the principles of the present invention.

FIG. 5 is a perspective view of the fluorescent film and the shadow mask according to the present invention. As can be seen from the drawing, the vertical pitch P3 of the tie bar 48 is set to be three times to the vertical pitch P4 of the black matrix 49. It is preferable that the vertical pitch P3 of the tie bar 48 is set an integer multiple of the vertical pitch P4 of the black matrix 49.

Figure 6:
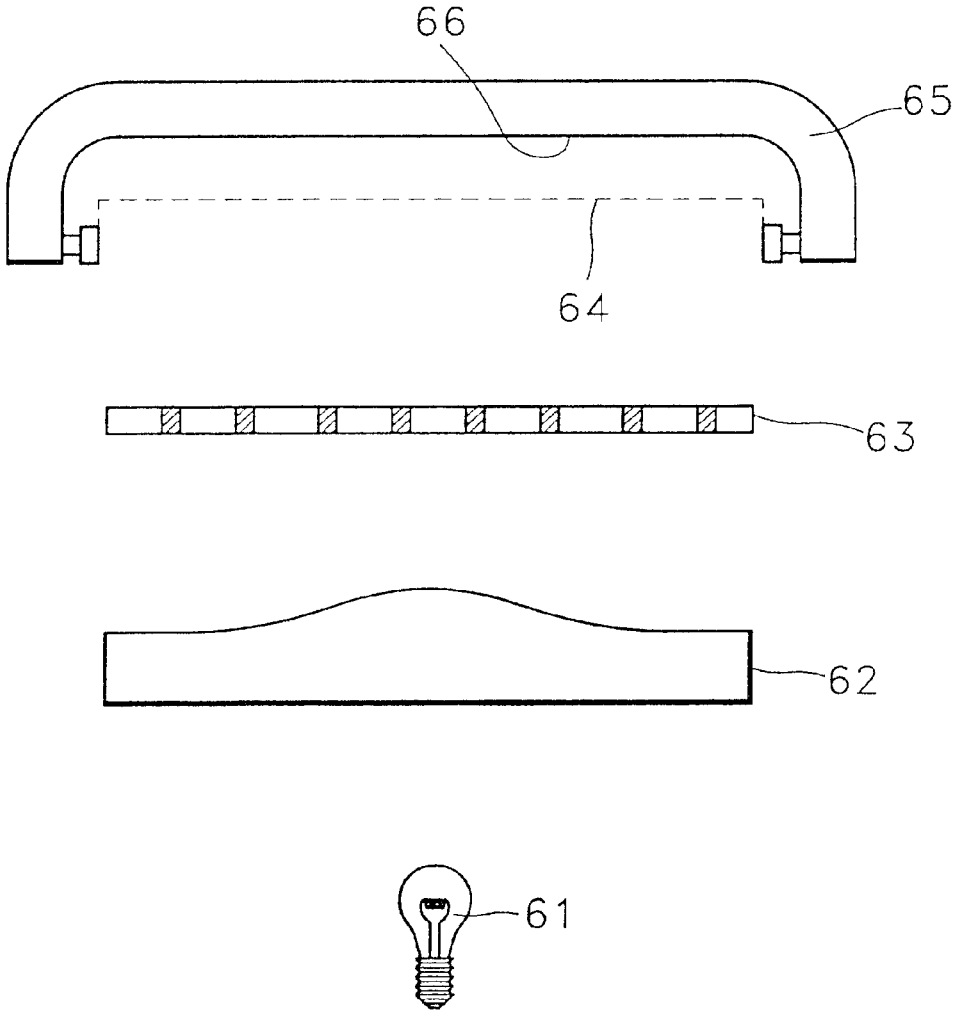
FIG. 6 is a view for explaining a method of light exposure of a black matrix pattern, in accordance with the principles of the present invention.

FIG. 6 shows a method of exposing the black matrix pattern according to the present invention to light. In the drawing, the exposure of the black matrix pattern is performed in a state in which the flat type shadow mask 64 is installed in a panel 65. The light coming from a light source 61 through the lens 62 and the shadow mask 64 is used in exposing a black matrix material coated on the inner surface of the panel 65. Here, as shown in FIG. 5, as the vertical pitch P3 of the tie bar 48 is greater than the vertical pitch P4 of the black matrix 49, an area of a screen 66 exposed to the light incident through the slits 47 may not match an area where the black matrix is to be formed. Thus, to correct the above mismatch, exposure is performed in a state in which a filter 63 is disposed between the shadow mask 64 and the lens 62. The filter 63 forms a pattern matching the area where the black matrix is formed on the screen 66 with the shadow mask 64. In other embodiment, the filter 63 may be disposed between the light source 61 and the lens 62.

As described above, in a flat type color cathode ray tube according to the present invention, fluorescent operation can be sufficiently performed and accordingly the black matrix is not recognized when a user views the color cathode ray tube. Thus, visual recognition performance is improved.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An apparatus, comprising:

a display unit conveying varying visual images to a user;

a fluorescent film being formed on a surface of said display unit, said fluorescent film having fluorescent patterns;

a black matrix being coated on said fluorescent film between said fluorescent patterns;

a mask being mounted adjacent to said display unit, said mask forming at least one tie bar, a plurality of slits, and a plurality of adjacent strips, said strips being disposed between said slits, said at least one tie bar connecting said adjacent strips, a first pitch of said black matrix and a second pitch of said at least one tie bar forming a predetermined ratio; and a light source emitting light through at least one of said slits to said display unit to form the images at said display unit.

2. The apparatus of claim 1, said apparatus corresponding to a flat type color cathode ray tube.

3. The apparatus of claim 1, further comprising:

a cathode ray tube corresponding to a flat type cathode ray tube, having a front flat region conveying the images to the user, having a funnel extending from said front flat region, said display unit corresponding to said front flat region;

said surface of said display unit with said fluorescent film formed thereon corresponding to an inner surface of said display unit, said inner surface facing an interior of said cathode ray tube; and a mask assembly unit being coupled to said cathode ray tube, said mask being connected to said mask assembly unit.

4. The apparatus of claim 1, said predetermined ratio corresponding to a ratio selected from among a first ratio with said first pitch being less than said second pitch and a second ratio with said first pitch being equal to said second pitch.

5. The apparatus of claim 4, further comprising:

a cathode ray tube corresponding to a flat type cathode ray tube, having a front flat region conveying the images to the user, having a funnel extending from said front flat region, said display unit corresponding to said front flat region;

said surface of said display unit having said fluorescent film corresponding to an inner surface of said display unit, said inner surface facing an interior of said cathode ray tube; and a mask assembly unit being coupled to said cathode ray tube, said mask being connected to said mask assembly unit.

6. The apparatus of claim 4, said first pitch being between 0.3 millimeters and 1.9 millimeters.

7. The apparatus of claim 4, said first pitch being between 0.4 millimeters and 1.5 millimeters.

8. The apparatus of claim 4, said second pitch being about 2.0 millimeters.

9. The apparatus of claim 4, said second pitch being at least 2.0 millimeters.

10. The apparatus of claim 4, said second pitch having a maximum size of 3.79 millimeters.

11. The apparatus of claim 4, said apparatus corresponding to a flat type color cathode ray tube.

12. The apparatus of claim 4, said predetermined ratio corresponding to said second pitch being an integer multiple of said first pitch.

13. The apparatus of claim 12, said predetermined ratio of said first pitch to said second pitch corresponding to 1:3.

14. A flat type color cathode ray tube display apparatus, comprising:

a flat type color cathode ray tube;

a flat type panel being located at a front region of said flat type color cathode ray tube;

fluorescent patterns being formed on an inner surface of said panel;

a black matrix being applied on said inner surface of said panel between said fluorescent patterns;

a flat type shadow mask being mounted adjacent to said panel, said mask forming at least one tie bar, a plurality of slits, and a plurality of adjacent strips, said strips being disposed between said slits, said at least one tie bar connecting said adjacent strips, a first measurement of said black matrix and a second measurement of said at least one tie bar forming a predetermined ratio; and an electron source emitting an electron beam passing through at least one of said slits of said mask to said panel to form an image, said mask being disposed between said electron source and said panel.

15. The apparatus of claim 14, said first and second pitch corresponding to first and second vertical pitch.

16. The apparatus of claim 15, said predetermined ratio corresponding to a ratio selected from among a first ratio with said first pitch being less than said second pitch and a second ratio with said first pitch being equal to said second pitch.

17. The apparatus of claim 16, said second pitch being about 2.0 millimeters.

18. The apparatus of claim 16, said second pitch being at least 2.0 millimeters.

19. The apparatus of claim 18, said second pitch having a maximum size of 3.79 millimeters.

20. The apparatus of claim 16, said second pitch having a maximum size of 3.79 millimeters.

21. The apparatus of claim 16, said predetermined ratio corresponding to said second pitch being an integer multiple of said first pitch.

22. The apparatus of claim 16, said first pitch being between 0.3 millimeters and 1.9 millimeters.

23. The apparatus of claim 22, said second pitch being about 2.0 millimeters.

24. The apparatus of claim 22, said second pitch having a maximum size of 3.79 millimeters.

25. The apparatus of claim 22, said predetermined ratio corresponding to said second pitch being an integer multiple of said first pitch.

26. The apparatus of claim 22, said second pitch being at least 2.0 millimeters.

27. The apparatus of claim 26, said second pitch having a maximum size of 3.79 millimeters.

28. The apparatus of claim 16, said first pitch being between 0.4 millimeters and 1.5 millimeters.

29. The apparatus of claim 28, said second pitch being about 2.0 millimeters.

30. The apparatus of claim 28, said second pitch having a maximum size of 3.79 millimeters.

31. The apparatus of claim 28, said predetermined ratio corresponding to said second pitch being an integer multiple of said first pitch.

32. The apparatus of claim 31, said predetermined ratio of said first pitch to said second pitch corresponding to 1:3.

33. The apparatus of claim 28, said second pitch being at least 2.0 millimeters.

34. The apparatus of claim 33, said second pitch having a maximum size of 3.79 millimeters.

35. A method, comprising:

forming a fluorescent film on a surface of a display unit, said fluorescent film having fluorescent patterns;

applying a black matrix onto said fluorescent film between said fluorescent patterns;

placing a mask at a location adjacent to said display unit, said mask forming at least one tie bar, a plurality of slits, and a plurality of adjacent strips, said strips being disposed between said slits, said at least one tie bar connecting said adjacent strips, a first pitch of said black matrix and a second pitch of said at least one tie bar forming a predetermined ratio; and emitting light through at least one of said slits to said display unit to form an image at said display unit.

36. The method of claim 35, said predetermined ratio corresponding to a ratio selected from among a first ratio with said first pitch being less than said second pitch and a second ratio with said first pitch being equal to said second pitch.

37. The method of claim 35, said display unit corresponding to a flat type color cathode ray tube.

38. The method of claim 37, said predetermined ratio corresponding to a ratio selected from among a first ratio with said first pitch being less than said second pitch and a second ratio with said first pitch being equal to said second pitch.

39. The method of claim 38, said first pitch being between 0.3 millimeters and 1.9 millimeters.

40. The method of claim 38, said first pitch being between 0.4 millimeters and 1.5 millimeters.

41. The method of claim 38, said second pitch being about 2.0 millimeters.

42. The method of claim 38, said second pitch being at least 2.0 millimeters.

43. The method of claim 38, said second pitch having a maximum size of 3.79 millimeters.

44. The method of claim 38, said predetermined ratio corresponding to said second pitch being an integer multiple of said first pitch.

45. The method of claim 44, said predetermined ratio of said first pitch to said second pitch corresponding to 1:3.

* * * * *